US011717977B1

(12) United States Patent
Xie

(10) Patent No.: US 11,717,977 B1
(45) Date of Patent: Aug. 8, 2023

(54) PAPER CUTTER

(71) Applicant: Xiaoxuan Xie, Hunan (CN)

(72) Inventor: Xiaoxuan Xie, Hunan (CN)

( * ) Notice: Subject to any disclaimer, the term of this patent is extended or adjusted under 35 U.S.C. 154(b) by 0 days.

(21) Appl. No.: 18/151,037

(22) Filed: Jan. 6, 2023

(30) Foreign Application Priority Data

Dec. 8, 2022 (CN) ..... 202223315206.2

(51) Int. Cl.
*B26B 27/00* (2006.01)
*B26D 1/04* (2006.01)
*B26B 29/06* (2006.01)

(52) U.S. Cl.
CPC ..... *B26B 27/00* (2013.01); *B26B 29/06* (2013.01); *B26D 1/045* (2013.01)

(58) Field of Classification Search
USPC ..... 30/298, 298.4; D8/98
See application file for complete search history.

(56) References Cited

U.S. PATENT DOCUMENTS 1,718,143 A 6/1929 Hancock
4,886,198 A 12/1989 De Larosiere
6,371,520 B1 * 4/2002 Wolff ..... B42F 9/008 281/47
D890,591 S * 7/2020 Lei ..... D8/98
D968,190 S * 11/2022 Tang ..... D8/98
2012/0125794 A1 * 5/2012 Elash ..... B65H 35/002 206/389
2012/0180324 A1 * 7/2012 Caldwell ..... B26B 27/007 30/298
2018/0345516 A1 * 12/2018 Perla ..... B26D 1/045

FOREIGN PATENT DOCUMENTS

DE 202012006366 U1 10/2013
FR 2 860 495 A1 * 4/2005

* cited by examiner

*Primary Examiner* — Hwei-Siu C Payer

(57) ABSTRACT

The present invention relates to a paper cutter, including a pipe body having a hollow channel, and a cutting tool mounted on the pipe body. The pipe body has a front end, a rear end, and a middle portion provided between the front end and the rear end. The middle portion is provided with a paper feeding gap and two guide inclined surfaces oppositely arranged. The arrangement that the paper feeding gap extends from the front end to the rear end through the guide inclined surfaces does not cause uneven cutting edges or tearing of a paper roll due to bending of edges of paper, such that a good cutting quality is achieved.

9 Claims, 2 Drawing Sheets

PAPER CUTTER

TECHNICAL FIELD

The present invention relates to the technical field of paper product cutting devices, and in particular, to a paper cutter.

BACKGROUND

Printing paper or printer paper is a kind of paper commonly used by people in work and life. In order to meet different use conditions, it is usually necessary to cut the paper into different lengths according to actual needs. At present, people mainly use scissors or blades to cut paper rolls. The use of scissors or blades to cut paper rolls has relatively low efficiency, and the cutting edges are often uneven, resulting in waste of defective products. Furthermore, the use of sharp scissors or blades has low security, and in particular, when the scissors or the blades are exposed in front of children, the children are likely to be in danger.

SUMMARY

In view of this, it is necessary to provide a paper cutter which has high cutting efficiency, good quality and safety in use, aiming at the problems existing in paper roll cutting.

A paper cutter, comprising: a pipe body having a hollow channel, and a cutting tool mounted on the pipe body, wherein the pipe body has a front end, a rear end, and a middle portion arranged between the front end and the rear end; the middle portion is provided with a paper feeding gap and two guide inclined surfaces oppositely arranged, an inlet of the paper feeding gap is provided on a pipe wall of the front end, the paper feeding gap extends from the front end to the rear end, the guide inclined surfaces are provided at the inlet of the paper feeding gap close to the front end, the cutting tool is provided within the paper feeding gap, and a sharp edge of the cutting tool is provided opposite to the front end.

In the described paper cutter, when in use, the paper roll is pulled and extended to form paper having a predetermined length, and the whole paper cutter is sleeved at one end of the paper roll to be cut by means of the hollow channel and the guide inclined surfaces, so that the paper passes through the paper feeding gap, and at this time, the edge of the paper is opposite to a cutting tool. The whole hand-held paper cutter is held and then is moved to the other end of the paper roll to cleanly cut the paper from the paper roll. The paper cutter can complete the cutting of paper by moving same in an assembled and fitted manner with a paper roll once, does not need to use scissors and blades which are inconvenient to operate, has high cutting efficiency and safety in use, does not cause uneven cutting edges or tearing of the paper roll due to bending of edges of paper by means of the arrangement of guide inclined surfaces, and has a good cutting quality.

In one of the embodiments, the middle portion is provided with a limiting inclined surface arranged in the paper feeding gap, and the limiting inclined surface is provided on a side of the cutting tool close to the front end.

In one of the embodiments, the paper feeding gap comprises a wide paper feeding port and a narrow paper feeding port, the wide paper feeding port is provided at the front end, and the narrow paper feeding port is provided opposite to the cutting tool.

In one of the embodiments, a cross-sectional dimension of the pipe body decreases from the front end toward the rear end.

In one of the embodiments, the middle portion is provided with two strip-shaped protrusions symmetrically arranged, and the strip-shaped protrusions are provided at two sides of the paper feeding gap.

In one of the embodiments, the strip-shaped protrusions extend from the front end to the rear end.

In one of the embodiments, a cross-sectional dimension of each of the strip-shaped protrusions gradually decreases from the front end toward the rear end.

In one of the embodiments, a cross section of each of the strip-shaped protrusions is semicircular.

In one of the embodiments, the middle portion is further provided with two receiving planes, and the receiving planes are provided between the paper feeding gap and the strip-shaped protrusions.

In one of the embodiments, a surface of the cutting tool away from the hollow channel is lower than the receiving planes.

BRIEF DESCRIPTION OF THE DRAWINGS

The drawings, which form a part of the present application, are used to provide a further understanding of the present invention. The schematic embodiments of the present invention and the description thereof are used to explain the present invention, and do not form improper limits to the present invention. In which.

DETAILED DESCRIPTION OF THE EMBODIMENTS

Figure 1:
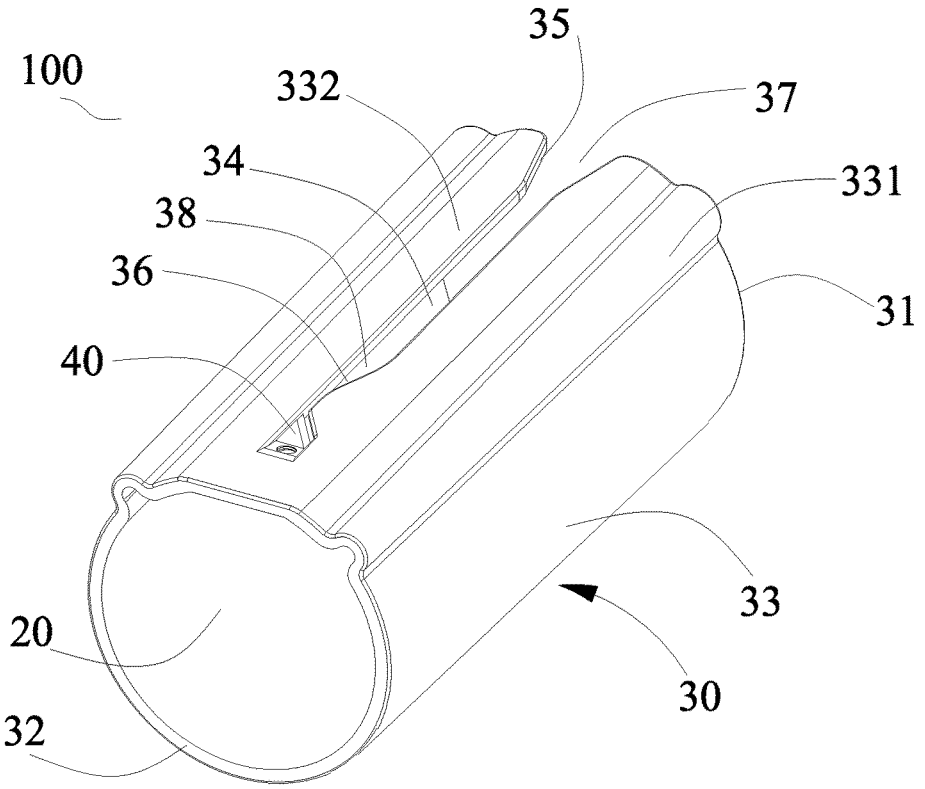
FIG. 1 is a schematic diagram of a paper cutter of the present invention.

The present invention will be described below with reference to the drawings and embodiments in detail. The respective examples are provided by means of explanation of the present invention without limiting the present invention. Indeed, it will be apparent to a person skilled in the art that modifications and variations can be made in the present invention without departing from the scope or spirit of the present invention. For example, features illustrated or described as being part of one embodiment can be used in another embodiment to yield yet another embodiment. Therefore, it is intended that the present invention cover such modifications and variations that fall within the scope of the appended claims and their equivalents.

In the description of the present invention, orientation or position relationships indicated by terms such as "longitudinal", "lateral", "up", "down", "front", "rear", "left", "right", "vertical", "horizontal", "top", and "bottom" are based on orientation or position relationships shown in the drawings, which are only used to facilitate description of the present invention rather than requiring that the present invention must be constructed and operated in a specific orientation, and therefore cannot be construed as a limitation on the present invention. The terms "connect", "connected" and "provided" used in the present invention should be understood broadly, for example, may be fixedly connected, and may also be detachably connected; may also be direct connections or indirect connections by means of intervening components; may also be wired connections or radio connections; and may also be wireless communication signal connections. A person skilled in the art would have been able to understand the specific meaning of the described terms according to specific situations.

One or more examples of the present invention are illustrated in the drawings. The detailed description uses numerals and letter labels to refer to features in the drawings. Similar or analogous labels in the drawings and descriptions have been used to refer to similar or analogous parts of the present invention. As used herein, the terms "first", "second", "third", etc., are used interchangeably to distinguish one member from another, and are not intended to represent the location or importance of the individual members.

In order to facilitate an understanding of the present invention, the present invention will now be described more fully hereinafter with reference to the drawings. Preferred embodiments of the present invention are shown in the drawings. The present invention can, however, be embodied in many different forms and is not limited to the embodiments described herein. Rather, these embodiments are provided so that the present invention will be thorough and complete.

It should be noted that, when an element is referred to as being "fixed to" another element, the element can be directly on the other element or can also have an intervening element. When an element is referred to as being "connected" to another element, it can be directly connected to the other element or intervening elements can be present at the same time. In addition, the term "and/or" herein is only an association relationship for describing associated objects, indicating that there can be three kinds of relationships, for example, A and/or B, which can indicate that there are three cases: A alone, A and B together, and B alone.

Unless defined otherwise, all technical and scientific terms used herein have the same meaning as commonly understood by a person skilled in the art to which the present invention belongs. The term used herein in the description of the present invention is for the purpose of describing particular embodiments only, such as "inner", "outer", "left", "right" and similar expressions are for illustrative purposes only and are not intended to limit the present invention.

Figure 2:
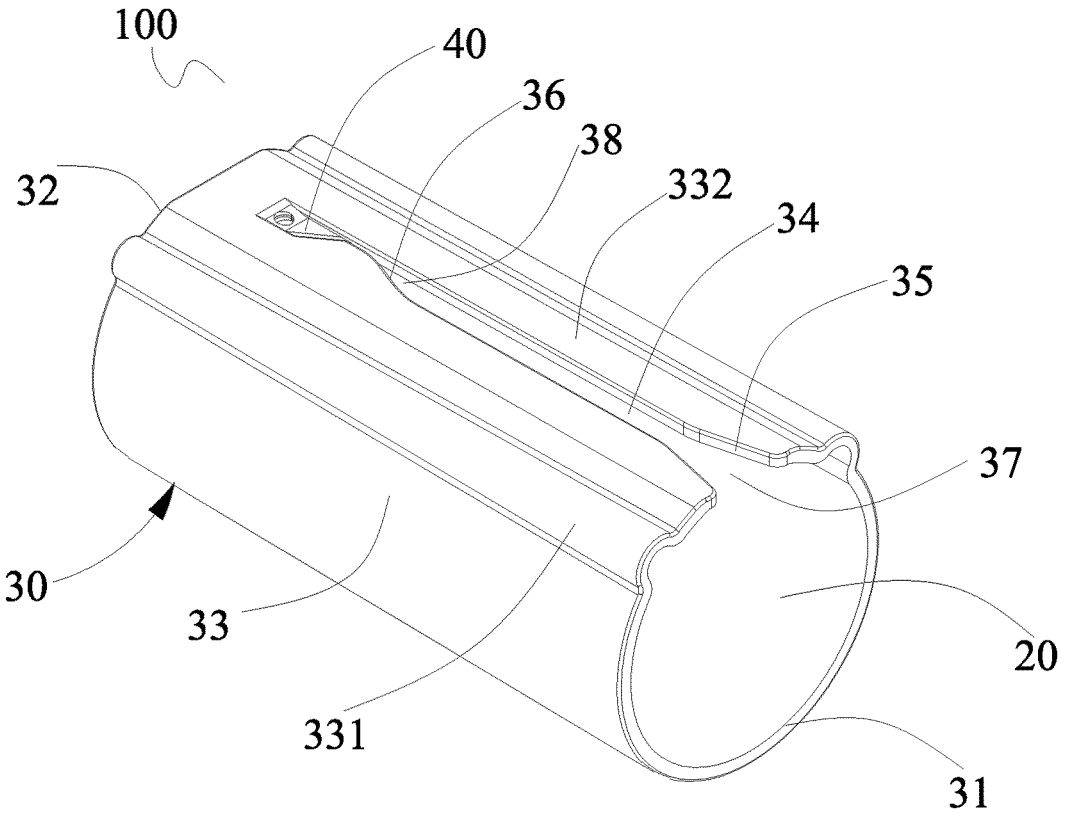
FIG. 2 is a schematic diagram of another view of the paper cutter of FIG. 1.
Figure 3:
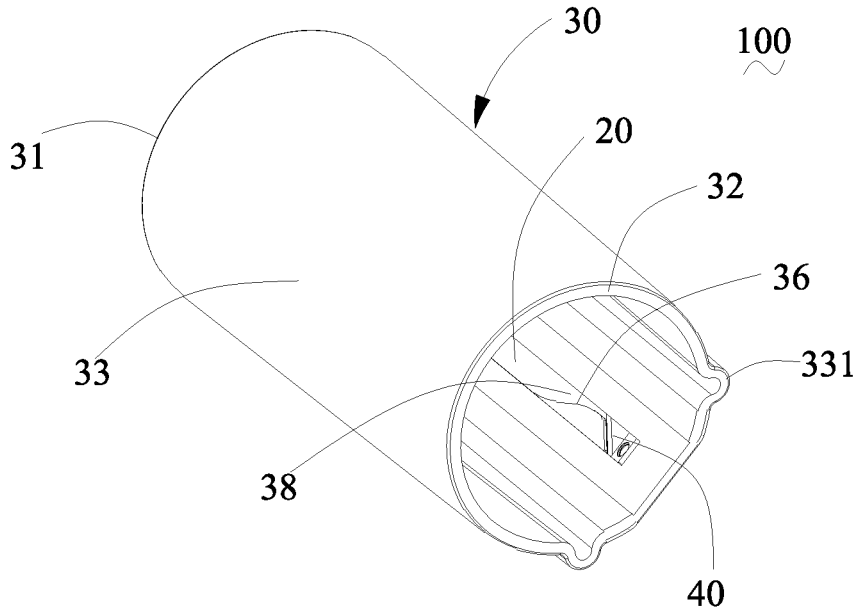
FIG. 3 is a schematic diagram of yet another view of the paper cutter of FIG. 1.
Figure 4:
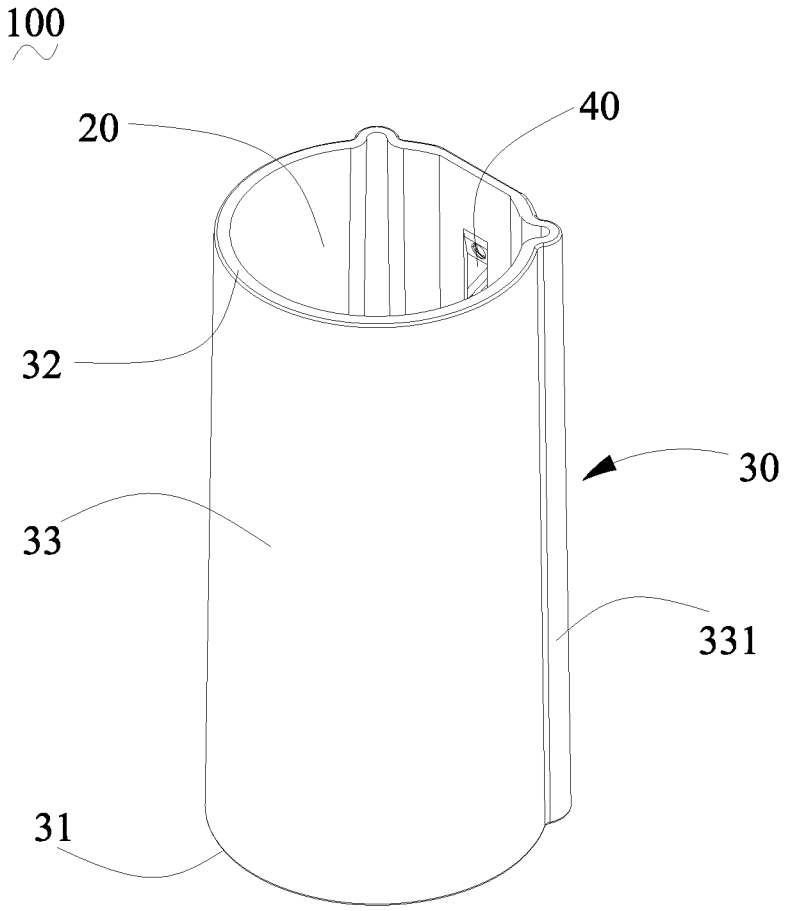
FIG. 4 is a schematic diagram of yet another view of the paper cutter of FIG. 1.

Please refer to FIGS. 1 to 4, they are schematic diagrams of a paper cutter 100 according to an embodiment of the present invention. The paper cutter 100 comprises a pipe body 30 having a hollow channel 20, and a cutting tool 40 mounted on the pipe body 30. When in use, the whole paper cutter 100 can be sleeved at one end of the paper roll to be cut by means of the hollow channel 20, and is cut by the cutting tool 40. In the present embodiment, the pipe body 30 is made of durable plastic, which is easy to use and durable.

Further, the pipe body 30 has an open front end 31, a rear end 32, and a middle portion 33 arranged between the front end 31 and the rear end 32, the middle portion 33 is provided with a paper feeding gap 34 and two guide inclined surfaces 35 oppositely arranged, and the paper feeding gap 34 extends from the front end 31 to the rear end 32, the guide inclined surfaces 35 are provided at one end of the paper feeding gap 34 close to the front end 31, and the cutting tool 40 is provided at one end of the paper feeding gap 34 away from the front end 31. The cutting tool 40 has a sharp cutting edge, the whole cutting tool 40 is embedded in the middle portion 33, and the cutting edge is provided towards the front end 31.

Further, the middle portion 33 is provided with a limiting inclined surface 36 arranged in the paper feeding gap 34, and the limiting inclined surface 36 is provided on a side of the cutting tool 40 close to the front end 31. Due to the arrangement of the guide inclined surfaces 35 and the limiting inclined surface 36, the paper feeding gap 34 comprises a wide paper feeding port 37 and a narrow paper feeding port 38, the wide paper feeding port 37 is provided at the front end 31, and the narrow paper feeding port 38 is provided opposite to the cutting tool 40, and thus it can be determined that the wide paper feeding port 37 and the narrow paper feeding port 38 are provided adjacent to each other in the longitudinal direction of the pipe body 30. Specifically, the wide paper feeding port 37 is trumpet-shaped, the narrow paper feeding port 38 extends at a predetermined angle to the cutting edge of the cutting tool 40, and the angle is between 10° and 60°, preferably 20°. The wide paper feeding port 37 is trumpet-shaped, which is beneficial that the paper does not bend at the edge when entering the paper feeding gap 34. The narrow paper feeding port 38 is provided such that the edge of the paper moving towards the cutting tool 40 touches the blade edge of the cutting tool 40 to form a certain shear force, thereby having small cutting resistance of the paper is small and smooth cutting.

Further, a cross-sectional dimension of the pipe body 30 gradually decreases from the front end 31 to the rear end 32, so that the whole pipe body 30 is similar to a conical pipe. When the whole paper cutter 100 is sleeved on a paper roll, the paper cutter has a certain guiding effect and also has certain shrinkage and finishing effects on the paper roll, so that when the paper roll is close to the cutting tool 40, the paper roll is wound tighter, and thus the edge of the paper is stable when the paper is touched and cut by the cutting tool 40, and the paper will not be loose and displaced, thereby ensuring cutting stability, and having good cutting effect.

Further, the middle portion 33 is provided with two strip-shaped protrusions 331 symmetrically arranged, the strip-shaped protrusions 331 are provided at two sides of the paper feeding gap 34, and the strip-shaped protrusions 331 extend from the front end 31 to the rear end 32. The two strip-shaped protrusions 331 can be arranged to form a support structure on the paper cutter 100, so that the whole paper cutter 100 can be stably placed on a table. Still further, a cross-sectional dimension of each of the strip-shaped protrusions 331 gradually decreases from the front end 31 to the rear end 32, so that the protrusions can adapt to the cross-sectional dimension of the pipe body 30, thereby making the whole structure layout more reasonable. In the present embodiment, a cross section of each of the strip-shaped protrusions 331 is semicircular, and the semicircular strip-shaped convex lugs 331 is arranged to make a contact surface more flexible, thereby facilitating a user to obtain a certain protection when holding. In other embodiments, the shape of the strip-shaped protrusions 331 can be changed according to actual requirements, such as isosceles trapezoid and isosceles triangle.

Further, the middle portion 33 is further provided with two receiving planes 332, and the receiving planes 332 are provided between the paper feeding gap 34 and the strip-shaped protrusions 331. The arrangement of the two receiving planes 332 enables the support structure of the whole paper cutter 100 to be smoother and the supporting area to be larger, thereby facilitating that the whole paper cutter 100 can be more stably placed on a table. Still further, a surface of the cutting tool 40 away from the hollow channel 20 is lower than the receiving plane 332, so that the cutting tool 40 is not exposed, and when the cutting tool is placed flat on a table, a hand can be prevented from touching the cutting tool 40 to cut the hand.

In the described paper cutter, when in use, the paper roll is pulled and extended to form paper having a predetermined length, and the whole paper cutter is sleeved at one end of the paper roll to be cut by means of the hollow channel and the guide inclined surfaces, so that the paper passes through the paper feeding gap, and at this time, the edge of the paper is opposite to a cutting tool. The whole hand-held paper cutter is held and then is moved to the other end of the paper roll to cleanly cut the paper from the paper roll. The paper cutter can complete the cutting of paper by moving same in an assembled and fitted manner with a paper roll once, does not need to use scissors and blades which are inconvenient to operate, has high cutting efficiency and safety in use, does not cause uneven cutting edges or tearing of the paper roll due to bending of edges of paper by means of the arrangement of guide inclined surfaces, and has a good cutting quality.

Various technical features of the described embodiments can be combined in any way, and in order to make the description brief, all possible combinations of the technical features in the described embodiments are not described. However, as long as the combination of these technical features is not contradictory, all of the technical features should be considered to belong to the scope of the description.

The foregoing embodiments only represent several implementations of the present invention, and are described in detail, but are not intended to limit the scope of the present invention. It should be noted that, for a person skilled in the art, various modifications and improvements can be made without departing from the concept of the present invention, and all these modifications and improvements belong to the scope of protection of the present invention. Therefore, the scope of protection of the present invention should be subject to the appended claims.

What is claimed is:

1. A paper cutter, comprising:

a pipe body having a hollow channel, and a cutting tool mounted on the pipe body, wherein the pipe body has a front end, a rear end, and a middle portion arranged between the front end and the rear end; the middle portion is provided with a paper feeding gap and two guide inclined surfaces oppositely arranged, an inlet of the paper feeding gap is provided on a pipe wall of the front end, the paper feeding gap extends from the front end to the rear end, the guide inclined surfaces are provided at the inlet of the paper feeding gap close to the front end, the cutting tool is provided within the paper feeding gap, and a sharp edge of the cutting tool is provided opposite to the front end;

a cross-sectional dimension of the pipe body gradually decreases from the front end toward the rear end.

2. The paper cutter of claim 1, wherein the middle portion is provided with a limiting inclined surface arranged in the paper feeding gap, and the limiting inclined surface is provided on a side of the cutting tool close to the front end.

3. The paper cutter of claim 2, wherein the paper feeding gap comprises a wide paper feeding port and a narrow paper feeding port, the wide paper feeding port is provided at the front end, and the narrow paper feeding port is provided opposite to the cutting tool.

4. The paper cutter of claim 1, wherein the middle portion is provided with two stripe-shaped protrusions symmetrically arranged, and the stripe-shaped protrusions are provided at two sides of the paper feeding gap.

5. The paper cutter of claim 4, wherein the strip-shaped protrusions extend from the front end to the rear end.

6. The paper cutter of claim 4, wherein a cross-sectional dimension of each of the strip-shaped protrusions gradually decreases from the front end toward the rear end.

7. The paper cutter of claim 6, wherein a cross section of each of the strip-shaped protrusions is semicircular.

8. The paper cutter of claim 4, wherein the middle portion is further provided with two receiving planes, and the receiving planes are provided between the paper feeding gap and the strip-shaped protrusions.

9. The paper cutter of claim 8, wherein a surface of the cutting tool away from the hollow channel is lower than the receiving planes.

* * * * *